United States Patent [19]

Ofusa

[11] 4,227,555

[45] Oct. 14, 1980

[54] WOVEN SLIDE FASTENER STRINGER

[75] Inventor: Masaatsu Ofusa, Kurobe, Japan

[73] Assignee: Yoshida Kogyo K.K., Tokyo, Japan

[21] Appl. No.: 945,566

[22] Filed: Sep. 25, 1978

[30] Foreign Application Priority Data

Sep. 26, 1977 [JP] Japan ..... 52/115362

[51] Int. Cl.[2] ..... A44B 19/10

[52] U.S. Cl. ..... 139/384 B; 24/205.16 C

[58] Field of Search ..... 139/384 B; 24/205.1 C, 24/205.13 C, 205.16 C

[56] References Cited

U.S. PATENT DOCUMENTS

| | | | |
|---|---|---|---|
| 3,765,457 | 10/1973 | Glindmeyer | 139/384 B |
| 3,822,444 | 7/1974 | Johns | 24/205.16 C |
| 4,058,144 | 11/1977 | Negro | 24/205.16 C |
| 4,058,145 | 11/1977 | Frohlich et al. | 24/205.16 C |
| 4,126,158 | 11/1978 | Scott | 24/205.16 C |

*Primary Examiner*—Henry Jaudon

*Attorney, Agent, or Firm*—Hill, Van Santen, Steadman, Chiara & Simpson

[57] ABSTRACT

A woven slide fastener stringer has a stringer tape including a weft thread woven in double picks with warp threads and having loops disposed along a longitudinal edge of the tape, a core thread extending through the weft loops, and a filamentary coupling element having turns each including a pair of limbs between which the core thread is disposed and connecting portions extending between adjacent two limbs. Each of the double picks has a portion extending around one of the connecting portions and between the one connecting portion and the core thread, and blending into adjacent two weft loops, thereby fastening the coupling element securely in position. Such a stringer is manufactured using a pair of monofilament and weft carriers insertable into and withdrawable out of warp sheds, a mandrel vertically shiftable into various shed positions, and in some embodiments means operatively coupled with the carriers for vertically displacing the threads and monofilament.

4 Claims, 33 Drawing Figures

WOVEN SLIDE FASTENER STRINGER

BACKGROUND OF THE INVENTION

1. Field of the Invention

The present invention relates to a slide fastener stringer having a woven stringer tape and a filamentary coupling element woven into the tape along a longitudinal edge thereof.

2. Prior Art

Slide fastener stringers including a woven coupling element are generally made on shuttleless looms or ribbon looms with a shuttle, the element being in the shape of a coil or zigzag formed from a monofilament. The monofilament is supplied warpwise or weftwise as it is shaped and woven into the tape while the tape is being produced. The monofilament has a plurality of widened, flattened portions formed as by stamping and disposed at spaced intervals therealong. The monofilament is bent or curved at such portions, and every other such portions acting as coupling heads of the element are bent around a mandrel arranged along the stringer tape, the remaining portions being curved around a core thread extending warpwise for being disposed in and along the coupling element. According to another prior process, no core thread is used and the monofilament is shaped into a meandering type element by being beaten up by a reed (Japanese Utility Model Laid-Open Publication No. 50-155339).

Difficulties common to such conventional slide fastener stringers are that the monofilament tends to be bent or curved irregularly and, when such irregularities build up, a resulting element becomes distorted in shape. Further, since the element is supported on the tape less securely and hence is positionally unstable, slide fasteners with such element cannot be used on articles that are expected to meet severe pulls.

SUMMARY OF THE INVENTION

According to the invention, a woven stringer tape includes a weft includes interlaced in double picks with warp threads and having loops extending from the double picks and arranged along a longitudinal edge of the tape, and a core thread extending warpwise through the loops in engagement therewith. A filamentary coupling element of the zigzag type has a plurality of turns each including a pair of limbs that sandwich the core thread, and a plurality of connecting portions each extending between adjacent two of the limbs that lie on one side of the core thread. Each double pick has a portion extending around one of the connecting portions and between said one connecting portion and the core thread, and blending into adjacent two of the loops.

To produce such a slide fastener stringer, a plastic monofilament is inserted into a warp shed around a mandrel and under the core thread, a weft thread is placed as a double pick in the shed over the core thread and across the inserted monofilament, and the monofilament is withdrawn from the shed under the core thread whereby the monofilament has a turned-over portion overlying the double pick. The monofilament is inserted again into a successive warp shed around the mandrel and over the core thread, the weft thread is placed as a double pick in the successive shed under the core thread and across the inserted monofilament, and the monofilament is withdrawn from the successive shed over the core thread whereby the monofilament has a turned-over portion underlying the last-named double pick.

It is an object of the present invention to provide a slide fastener stringer having a woven coupling element that is fastened securely in place.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
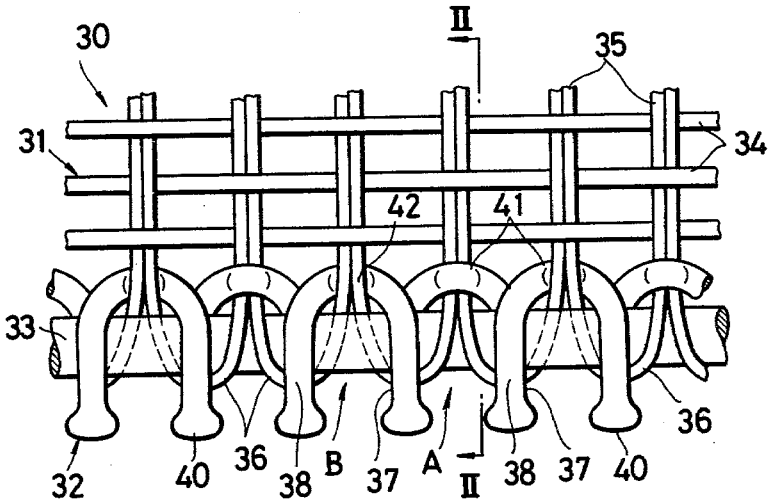
FIG. 1 is an enlarged fragmentary plan view of a slide fastener stringer constructed in accordance with the present invention, the stringer being shown exaggerated for clarity.
Figure 2:
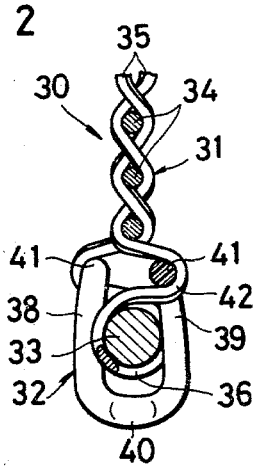
FIG. 2 is a cross-sectional view taken along line II—II of FIG. 1.

The principles of the present invention are particularly useful when embodied in a slide fastener stringer such as schematically shown in FIGS. 1 and 2, generally indicated by the numeral 30.

The slide fastener stringer 30 essentially comprises a woven stringer tape 31, a coupling element 32 of the zigzag type made of a plastic monofilament and mounted on and along a longitudinal edge of the tape 31, and a core thread 33 extending in and along the coupling element 32. The stringer tape 31 is composed of a plurality of warp threads 34 and a single weft thread 35 interwoven or interlaced in double picks with the warp threads 34, the weft thread 35 having a plurality of loops 36 disposed along the longitudinal edge of the tape 31, thereby constituting a tape selvage. Each loop 36 extends from adjacent two of the double picks of the weft thread 35.

The core thread 33 extends warpwise along the longitudinal tape edge and through the weft loops 36 which are held in wrapping engagement with the core thread 33. The filamentary coupling element 32 has a plurality of turns 37 extending weftwise or transversely of the tape 31 and spaced from each other longitudinally of the tape 31. Each turn 37 includes a pair of spaced upper and lower limbs 38, 39 between which the core thread 33 is disposed and a coupling head 40 extending between the limbs 38, 39. The coupling element 32 also has a plurality of arcuate connecting portions 41 extending between adjacent two of the limbs 38 and 39 which are located on one peripheral side of the core thread 33. The plastic monofilament, before being shaped into such a coupling element, is stamped or otherwise deformed at selected intervals therealong to provide a plurality of widened, flattened portions. When the monofilament is being formed into the coupling element 32, such flattened portions permit the monofilament to be bent or folded over easily at such portions. Every other flattened portions function as the coupling heads 40, the remaining portions acting as a point of reversal at the connecting portions 41.

As better shown in FIG. 2, each of the double picks has a portion 42 extending around and over one of the connecting portions 41 and between said one connecting portion 41 and the core thread 33, and blending into adjacent two of the weft loops 36. Accordingly, the connecting portions 41 of the coupling element 32 are fastened in position by the double pick portions 42 with the upper and lower limbs 38, 39 pressed toward each other against the core thread 33 that is anchored in the coupling element 32 by the weft loops 36.

Figure 3:
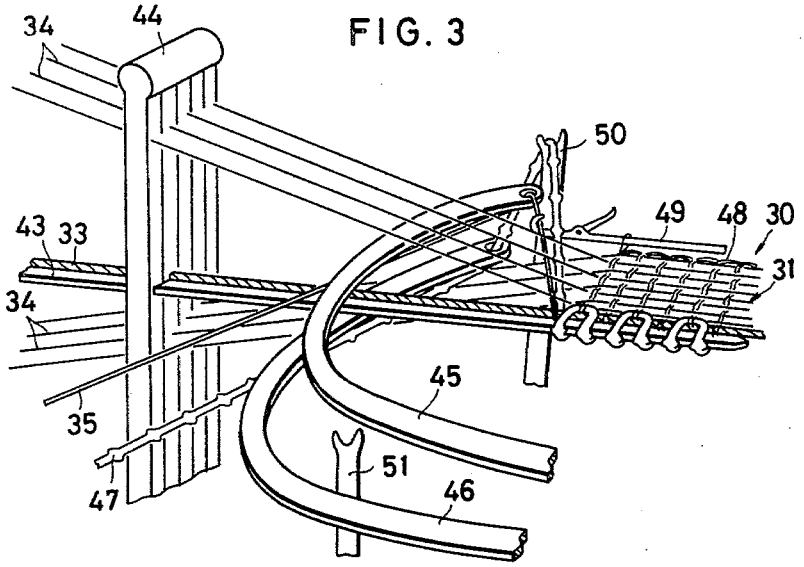
FIGS. 3 and 4 are perspective views illustrative of the way in which the stringer shown in FIGS. 1 and 2 is produced according to a first method embodiment of the invention.
Figure 4:
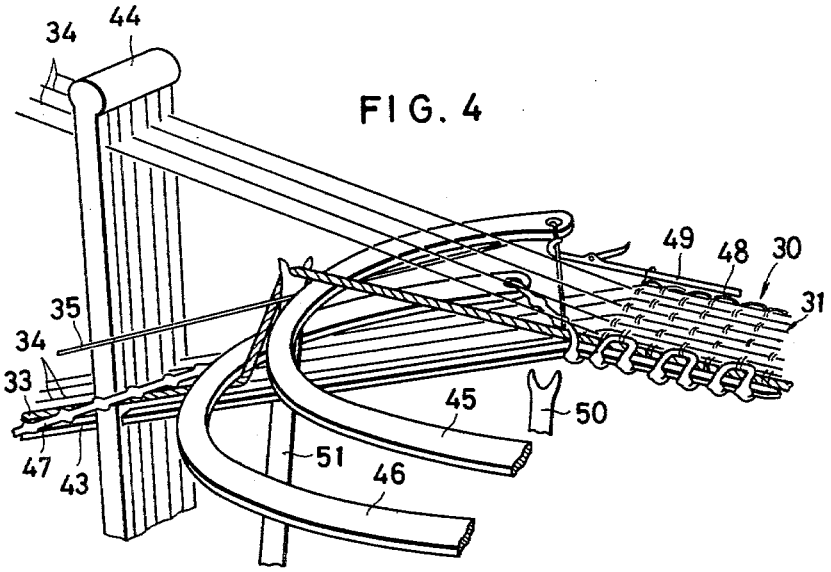

FIGS. 3 and 4 illustrate the way in which the stringer 30 is manufactured in accordance with a first method embodiment. A split shedding system is used for shedding the warp threads 34 and the core thread 33, that is, for the shedding as shown in FIG. 3, a first group of warp threads 34 is in an upper shed position, a second group of warp threads 34 in a lower shed position and the core thread 33 in an intermediate shed position when a section A (FIG. 1) of the stringer 30 is produced. For forming a section B of the stringer 30, the first warp group is in the lower shed position, the second warp group in the upper position and the core thread 33 in the lower position, as shown in FIG. 4.

There is a mandrel 43 in the form of an elongate strip of stainless steel, extending along the core thread 33 and movable up and down with the core thread 33 during shedding. The warp threads 34, core thread 33, and mandrel 43 are threaded through a reed 44 that beats up the fell of the stringer tape 31. A pair of upper and lower arcuate carriers 45, 46 are pivotable so as to move across the warp shed with the upper carrier 45 over the core thread 33 and the mandrel 43 as they are in the middle shed position and the lower carrier 46 under them. The upper carrier 45 carries the weft thread 35 and is referred to as a filling carrier. The lower carrier 46 carries a monofilament 47 and is referred to as a monofilament carrier. Disposed along a tape edge 48 that is remote from the core thread 33 is a latch needle 49 horizontally reciprocable for catching the weft thread 35 inserted in the warp shed by the filling carrier 45. A pair of vertically movable lifters 50, 51 are located one on each side of the warp threads 34 for elevating the monofilament 47 and the core thread 33, respectively.

To form the stringer section A, the warp threads 34, core thread 33 and mandrel 43 are first shed as illustrated in FIG. 3, and then the monofilament carrier 46 is inserted below the mandrel 43 so as to introduce the monofilament 47 into the warp shed around the mandrel 43 and under the core thread 33 adjacent to the tape fell. The lifter 50 is raised until it engages and lifts the inserted monofilament to the extent that the elevated monofilament 47 provides a space therebelow large enough to admit the latch needle 49. Then, the filling carrier 45 is inserted over the core thread 33 to place the weft thread 35 in the warp shed over the core thread 33 and across the inserted monofilament 47 as it is raised. The inserted weft thread 35 is caught below the lifted monofilament 47 and knitted by the latch needle 49 to produce a selvage along the tape edge 48, and the filling carrier 45 is retracted from the warp shed, leaving a double pick in the warp shed. Thereafter, the monofilament lifter 50 is lowered until it disengages the monofilament 47, which is then withdrawn from the warp shed under the core thread 33 by moving back the monofilament carrier 46. At this time, the monofilament 47 as it is withdrawn forms a turned-over portion by engagement with the double pick, such turned-over portion overlying the double pick at a point of reversal thereof and acting as a connecting portion 41 of the coupling element 32. Finally, the reed 44 beats up the inserted weft thread 35 into the fell of the tape 31, and at the same time presses the turned-over portion of the monofilament 35 into a proper configuration. The formation of the stringer section A is thus completed.

To form the stringer section B, the monofilament carrier 46 is moved over the mandrel 43 and core thread 33 that are in the lower shed position as shown in FIG. 4, into a consecutive warp shed formed by separating the warp threads 34 again, thereby inserting the monofilament 47 into the successive warp shed around the mandrel 43 and over the core thread 33. The lifter 51 is raised until it lifts the core thread 33, and then the filling carrier 45 is inserted across the warp shed below the elevated core thread 33 thereby introducing the weft thread 35 into the warp shed under the core thread 33 and across the monofilament 47. The weft thread 35 thus put in the warp shed is caught and knitted by the latch needle 49, and is left in the warp shed as a double pick after the filling carrier 45 is drawn out. The core thread lifter 51 then descends and the monofilament carrier 46 is retracted to draw the monofilament 47 over the core thread 33, whereupon a turned-over portion of the monofilament 47 underlies and is retained in position by the double pick of the inserted weft thread 35.

According to a second method embodiment (FIG. 5), a pair of upper and lower arcuate carriers 52, 53 carry the monofilament 47 and the weft thread 35, respectively, there being a lifter 54 for raising the weft thread 35 inserted in the warp shed. A latch needle 55 is horizontally movable along the tape edge 48 and, as will be described, is vertically shiftable at its hooked end in order to catch the weft thread 35 at positions above and below the monofilament 47 as inserted by the monofilament carrier 52. The core thread 33 and the mandrel 43 are movable together between the middle and upper shed positions. There is a depressor 56 for engaging and pressing the core thread 33 in the upper shed position downwardly beyond the middle shed position.

Figure 5:
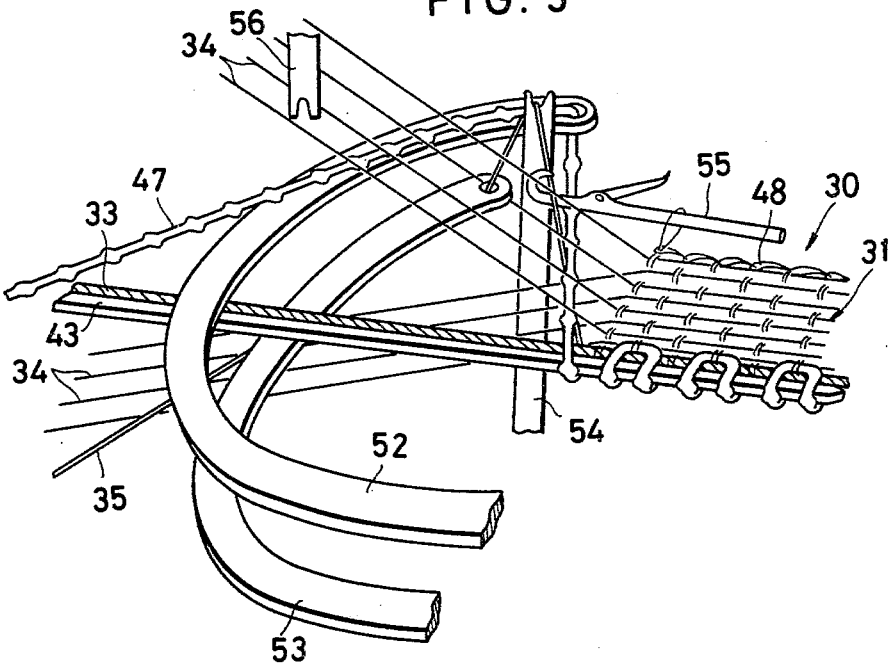
FIG. 5 is a perspective view illustrative of the way in which the stringer is produced according to a second method embodiment of the invention.

FIG. 5 shows the position of the parts while the section B (FIG. 1) of the stringer 30 is being produced. The warp threads 34 are divided into the upper and lower shed positions, with the core thread 33 and the mandrel 43 being in the middle shed position. The monofilament carrier 52 is first moved to introduce the monofilament 47 around the mandrel 43 and over the core thread 33 into the warp shed, and then the filling carrier 53 is actuated to insert the weft thread 35 under the core thread 33 and into the warp shed. Upon full insertion of the weft thread 35, the weft lifter 54 is moved upwardly to raise the weft thread 35 beyond the inserted monofilament 47, whereupon the latch needle 55 moves forwardly over the monofilament 47 and seizes the elevated weft thread 35. As the weft lifter 54 descends, the latch needle 55 is retracted to knit the weft thread 35 with a preceding selvage loop at the tape edge 48, and the filling carrier 53 is withdrawn from the warp shed to leave the weft thread 35 as a double pick therein. Then, by the withdrawal of the monofilament carrier 52, the monofilament 47 is retracted from the warp shed, producing a turned-over portion that underlies the double pick.

For weaving the stringer section A, the warp threads 34 are shed again to form a successive shed, and the core thread 33 and the mandrel 43 are brought to the upper shed position. The monofilament carrier 52 is actuated to place the monofilament 47 in the warp shed around the mandrel 43 and under the core thread 33. Then, the core thread depressor 56 is moved downwardly until the core thread 33 is depressed from the upper shed position to a point below the middle shed position. Thereafter, the filling carrier 53 is moved into the warp shed above the lowered core thread 33 to insert the weft thread 35. When the weft thread 35 is inserted completely, the latch needle 55 is advanced with its hooked end lowered and passing below the inserted monofilament 47 to catch the weft thread 35, and then the needle 55 is retracted to knit the weft thread 35 it has caught with a preceding weft loop at the tape edge 48. At the same time, the filling carrier 53 is withdrawn to leave a double pick in the warp shed, whereupon the core thread depressor 56 is lifted to allow the core thread 33 to return to the upper shed position. Then, the monofilament carrier 52 is retracted from the warp shed to leave the monofilament as a turned-over portion overlying and fastened by the double pick.

Figure 6:
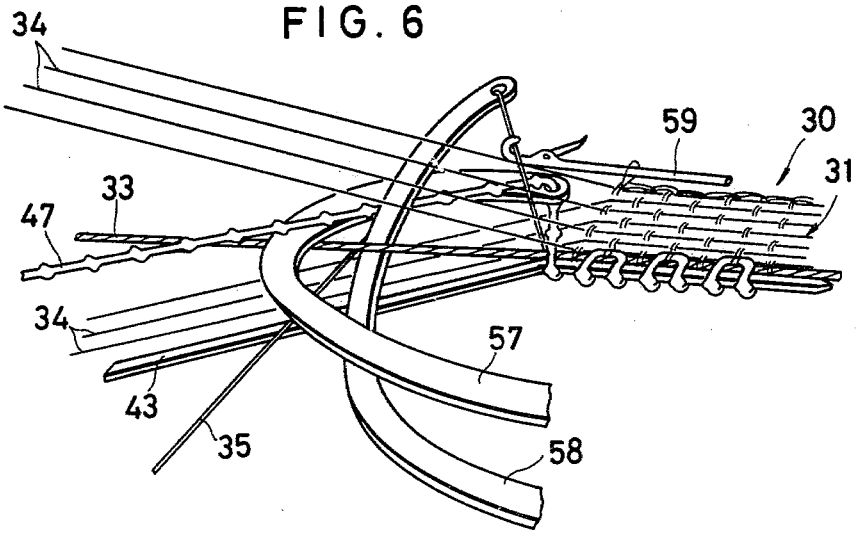
FIG. 6 is a perspective view illustrative of the way in which the stringer is produced according to a third method embodiment.

FIG. 6 illustrates a third method embodiment in which a pair of monofilament and filling carriers 57, 58 are movable across each other in a warp shed, each of the carrier 57, 58 also being angularly and vertically movable between two spaced positions outside the warp shed. The core thread 33 is held in the middle shed position at all times, and the mandrel 43 is vertically shiftable between the middle and lower shed positions.

The stringer section B as shown in FIG. 1 is produced as follows: The warp threads 34 are shed into the upper and lower shed positions with the mandrel 43 in the lower shed position. The monofilament carrier 57 which is angularly disposed above the filling carrier 58 is inserted obliquely downwardly into the warp shed between the upper and middle shed positions so as to introduce the monofilament 47 around the mandrel 43 and over the core thread 33. Then, the filling carrier 58 which is angularly disposed below the monofilament carrier 57 is inserted obliquely upwardly into the warp shed between the lower and middle shed positions so as to extend across the monofilament carrier 57 and place the weft thread 35 upwardly of the monofilament 47 previously inserted in the warp shed. With the weft thread 35 fully inserted, it is caught by a latch needle 59 and knitted with a preceding selvage loop. The filling carrier 58 is withdrawn from the warp shed with the weft thread 35 laid as a double pick in the warp shed and then the monofilament carrier 57 is retracted, thereby causing the monofilament 47 to form a turned-over portion which at a point of reversal underlies the double pick.

Preparatory to the formation of the stringer section A, the warp threads 34 are shed again and the mandrel 43 is shifted upwardly to the middle shed position. The monofilament carrier 57 located outside the warp shed is downwardly moved as it is angularly displaced so that it will substantially assume the position and orientation the filling carrier 58 has had. Conversely, the filling carrier 58 outside the warp shed is upwardly moved as it is angularly displaced so that it will substantially assume the position and orientation the monofilament carrier 57 has had. The monofilament carrier 57 is inserted obliquely upwardly between the middle and lower shed positions into the warp shed to place the monofilament 47 therein, and the filling carrier 58 is then inserted obliquely downwardly between the upper and middle shed positions into the warp shed so as to introduce the weft thread 35 under the monofilament 47 in the warp shed. The latch needle 59 travels forwardly and is directed downwardly to enable its hook to catch the inserted weft thread 35 beneath the monofilament 47. Then, the filling carrier 58 and the monofilament carrier 57 are moved back out of the warp shed to leave the weft thread 35 as a double pick and the monofilament 47 as a turned-over portion overlying the double pick.

Figure 7:
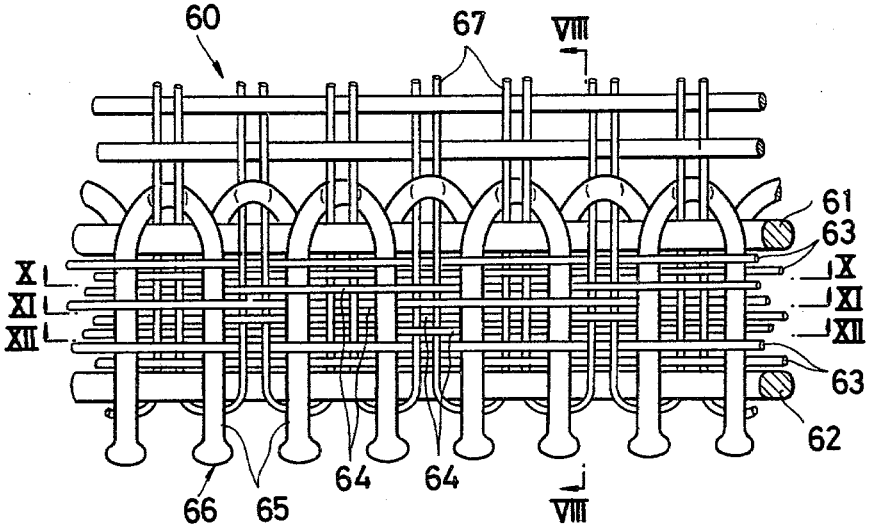
FIG. 7 is an enlarged fragmentary plan view of a modified slide fastener stringer.
Figure 8:
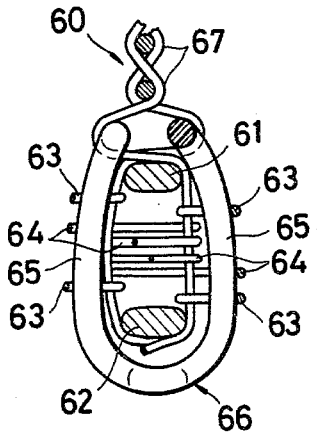
FIG. 8 is a cross-sectional view taken along line VIII—VIII of FIG. 7.
Figure 9:
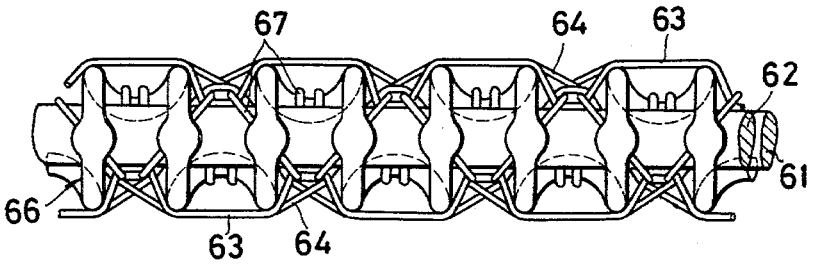
FIG. 9 is a front elevational view of the stringer of FIG. 7.
Figure 10:
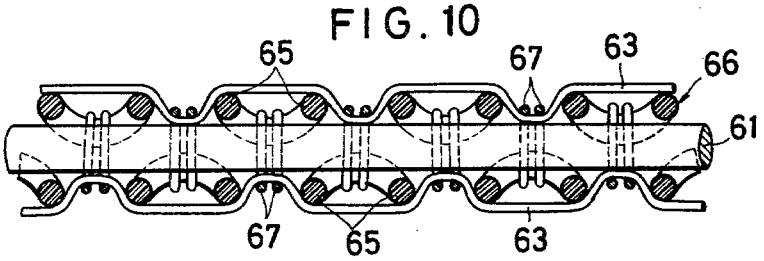
FIG. 10 is a cross-sectional view taken along line X—X of FIG. 7.
Figure 11:
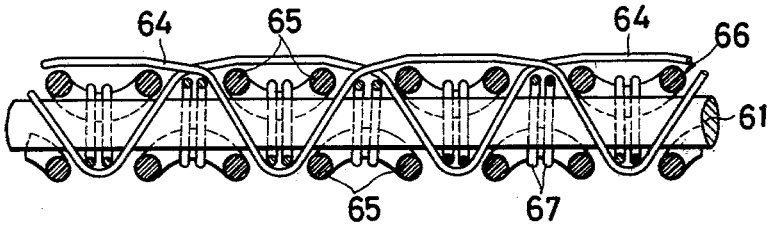
FIG. 11 is a cross-sectional view taken along line XI—XI of FIG. 7.
Figure 12:
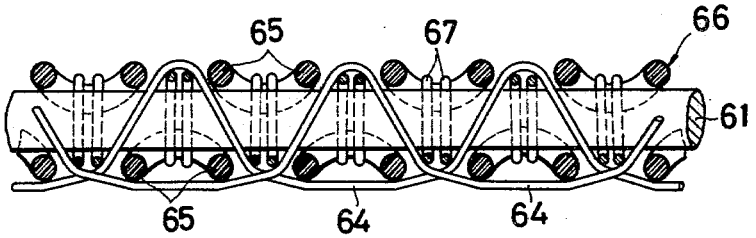
FIG. 12 is a cross-sectional view taken along line XII—XII of FIG. 7.

A modified slide fastener stringer 60 shown in FIGS. 7 and 8 is substantially the same as the stringer 30 of FIGS. 1 and 2, but differs therefrom in that the modification includes a pair of core threads 61, 62 and a plurality of additional warp threads 63, 64 disposed between the core threads 61, 62 in engagement with the limbs 65 of a coupling element 66 and with the double picks of a weft thread 67. The inclusion of such additional threads 63, 64 is well known and practiced in the art, and the threads 63, 64 may be divided into two groups in terms of function. One such group is composed of the threads 63 as shown in FIG. 10, which run on both sides of the stringer 60 over the element limbs 65 and under the weft thread 67 so as to cover the coupling element 66, and the other group includes the threads 64 as shown in FIGS. 11 and 12, which overlie the element limbs 65 and extend repeatedly across the tape edge and around the double picks of the weft thread 67, thereby fastening the element limbs 65 securely in place.

Figure 13:
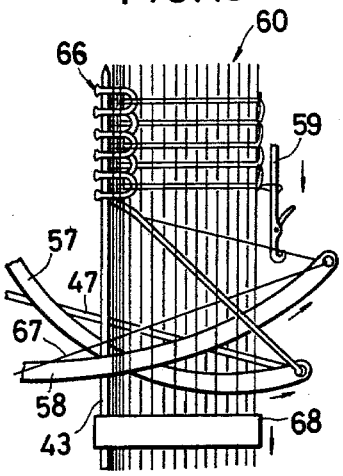
FIGS. 13, 14, 15 and 16 are fragmentary plan views showing progressive steps in which the stringer of FIG. 7 is manufactured.
Figure 14:
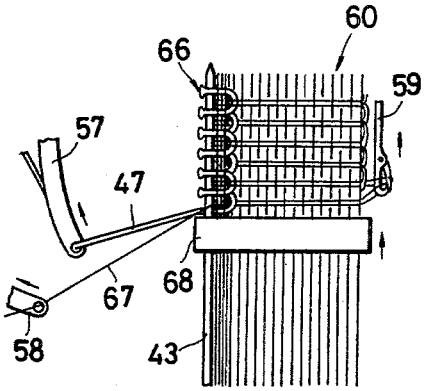
Figure 13A:
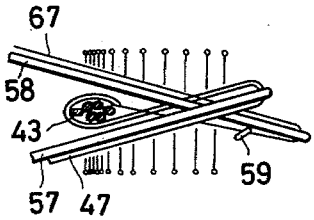
FIGS. 13*a*, 14*a*, 15*a* and 16*a* are front elevational views as seen from the bottom of FIGS. 13, 14, 15 and 16, respectively.
Figure 14A:
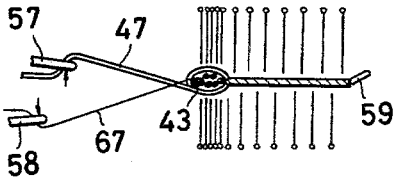
Figure 15:
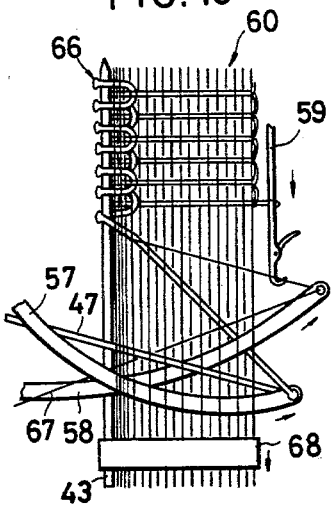
Figure 16:
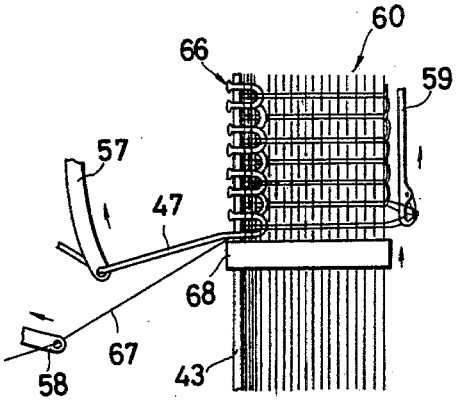
Figure 15A:
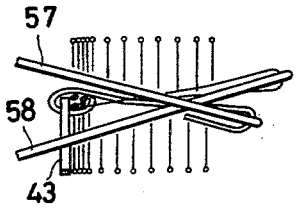
Figure 16A:
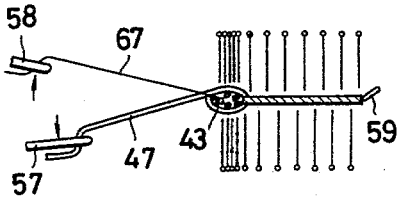

FIGS. 13 through 16 and **13*a* through 16*a* schematically illustrate the way in which the slide fastener stringer 60** is progressively woven utilizing the method as explained with reference to FIG. 6. The additional warp threads 63, 64 are divided into the upper, middle, and lower shed positions. In FIGS. 13 and 13*a*, with the mandrel 43 in the middle shed position, the monofilament carrier 57 is inserted obliquely upwardly between the lower and middle shed positions and, slightly later, the filling carrier 58 is inserted obliquely downwardly between the upper and middle shed positions. After the weft thread 67 is caught by the latch needle 59, the filling carrier 58 and then the monofilament carrier 57 are retracted from the warp shed (FIG. 14), whereupon a reed 68 beats up the tape fell. Outside the warp shed the monofilament carrier 57 is raised and the filling carrier 58 is lowered so that they will positionally replace each other as best shown in FIG. 14*a*. Upon completion of the following shedding with the mandrel 43 in the lower shed position (FIGS. 15 and 15*a*), the monofilament carrier 57 is introduced obliquely downwardly between the upper and middle shed positions, followed by introduction of the weft carrier 58 obliquely upwardly between the lower and middle shed positions. The latch needle 59 catches the weft-thread 67, whereupon the filling carrier 58 and the monofilament carrier 57 are withdrawn (FIG. 16), and they are vertically interchanged (FIG. 16*a*).

Figure 17:
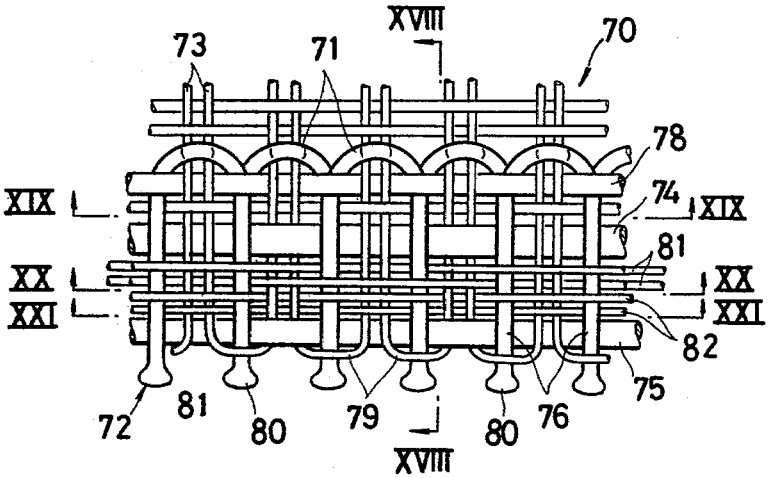
FIG. 17 is an enlarged fragmentary plan view of another modified stringer.
Figure 18:
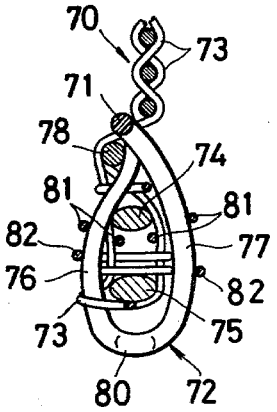
FIG. 18 is a cross-sectional view taken along line XVIII—XVIII of FIG. 17.
Figure 19:
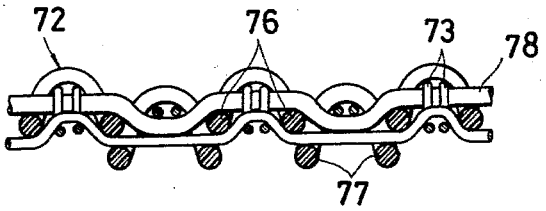
FIG. 19 is a cross-sectional view taken along line XIX—XIX of FIG. 17.

According to another modified slide fastener stringer 70 shown in FIGS. 17 and 18, the connecting portions 71 of a coupling element 72 overlie the double picks of a weft thread 73, and a pair of core threads 74, 75 extend warpwise between the upper and lower limbs 76, 77 of each turn of the coupling element 72. A reinforcing warp thread 78 runs on and along the coupling element 72 and is located near the connecting portions 71 of the coupling element 72, the warp thread 78 being fastened between the weft double picks and the upper element limbs 76.

Figure 20:
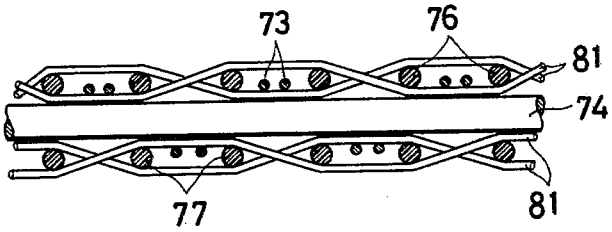
FIG. 20 is a cross-sectional view taken along line XX—XX of FIG. 17.
Figure 21:
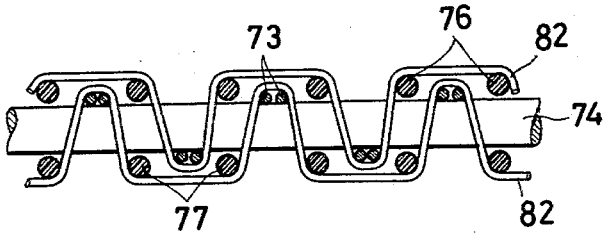
FIG. 21 is a cross-sectional view taken along line XXI—XXI of FIG. 17.

Otherwise expressed, each of the weft double picks underlies one of the connecting portions 71 and overlies the reinforcing warp thread 78 and blends into adjacent two loops 79 of the weft thread 73. Accordingly, the connecting portions 71 of the coupling element 72 are raised toward the reinforcing warp thread 77 by engagement with the double picks of the weft thread 73. The weft thread 73 is disposed astride of or extends across and over the upper element limbs 76 adjacent to the coupling heads 80 of the coupling element 72. A plurality of additional warp threads 81, 82 are interlaced with the element limbs 76. 77. As shown in FIG. 20, the warp threads 81 are interwoven independently with the upper and lower limbs 76, 77, and as shown in FIG. 21 the warp threads 82 overlie the upper limbs 76 and underlie the weft double picks extending under the core threads 74, 75, and also underlie the lower limbs 77 and overlie the weft double picks extending over the core threads 74, 75.

Figure 22:
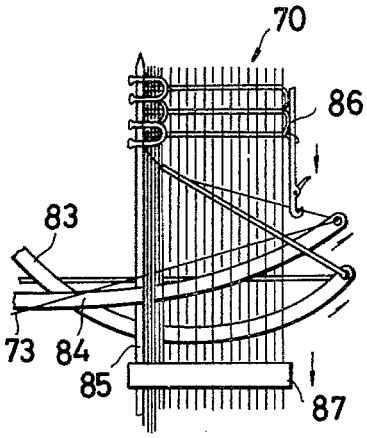
FIGS. 22, 23, 24 and 25 and fragmentary plan views showing successive steps in which the stringer illustrated in FIG. 17 is progressively produced.
Figure 23:
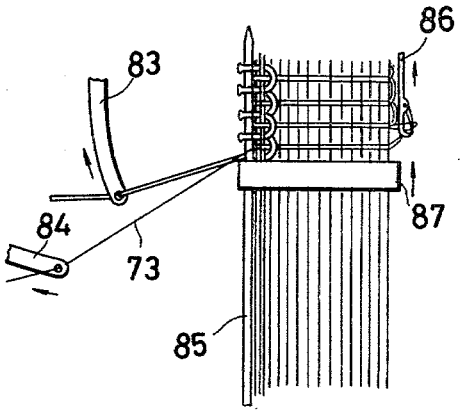
Figure 22A:
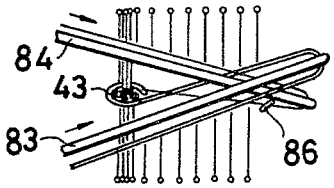
FIGS. 22*a*, 23*a*, 24*a* and 25*a* are front elevational views as seen from the bottom of FIGS. 22, 23, 24 and 25, respectively.
Figure 23A:
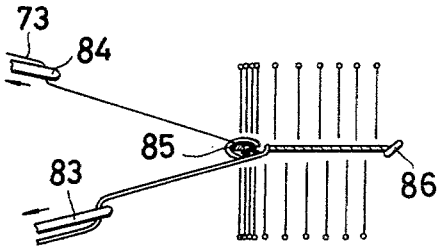
Figure 24:
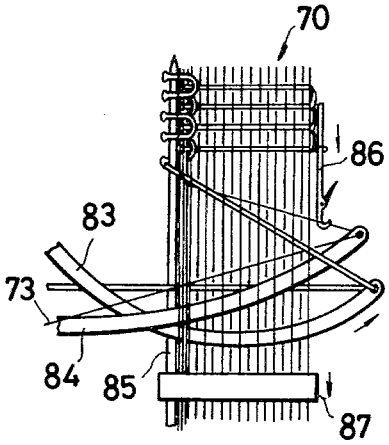
Figure 25:
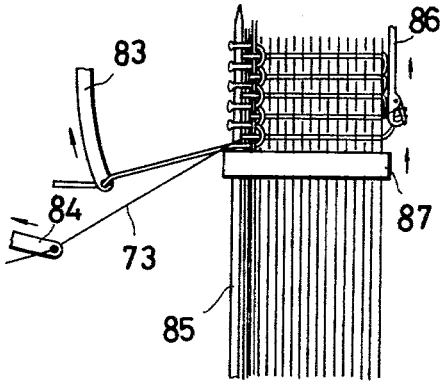
Figure 24A:
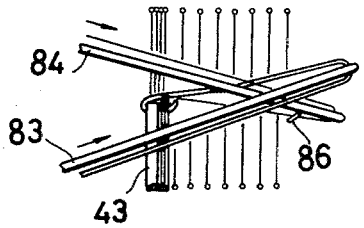
Figure 25A:
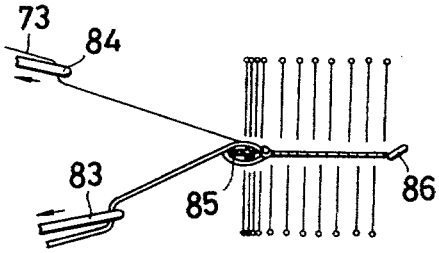

The slide fastener stringer 70 illustrated in FIGS. 17 through 21 is produced by the progressive steps shown in FIGS. 22 through 25 and 22*a* through 25*a*, in which the mandrel 43 is movable between the middle and lower shed positions, the additional warp threads 81, 82 between the upper, middle and lower shed positions, and the reinforcing warp thread 78 held in the middle shed position. A monofilament carrier 83 is insertable and retractable between the middle and lower shed positions at all times, a filling carrier 84 is always between the middle and upper shed positions, and they are never interchangeable positionally. In FIGS. 22 and 22*a*, a mandrel 85 is in the middle shed position, and the monofilament and filling carriers 83, 84 are inserted obliquely upwardly and downwardly, respectively. When the weft thread 73 is caught by a latch needle 86, the carriers 83, 84 are withdrawn (FIGS. 23 and 23*a*) and a reed 87 beats up the tape fell. As soon as a successive warp shed is formed and the mandrel 85 is brought to the lower shed position, the monofilament and filling carriers 83, 84 are inserted again as illustrated in FIGS. 24 and 24*a*. The latch needle 86 catches the introduced weft thread 73, the carriers 83, 84 are retracted, and the tape fell is beaten up by the reed 87. Then, the mandrel 85 is brought to the middle shed position and a further successive shedding is carried out for repeated weaving operation.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A slide fastener stringer comprising:

(a) a woven stringer tape including a plurality of warp threads and a weft thread interlaced in double picks with said warp threads, said weft thread having a plurality of loops disposed along a longitudinal edge of said stringer tape and each extending from adjacent two of said double picks;

(b) a core thread extending warpwise through said loops in engagement therewith; and (c) a filamentary coupling element having a plurality of turns spaced longitudinally of the tape, each of said turns including a pair of spaced limbs between which said core thread extends, and a coupling head disposed between said limbs, said element further having a plurality of connecting portions each extending between adjacent two of said limbs which are located on one side of said core thread, each of said double picks having a portion extending around one of said connecting portions and between said one connecting portion and said core thread, and blending into adjacent two of said loops.

2. A slide fastener stringer according to claim 1, including another core thread extending through said loops and located adjacent to said coupling heads, and a plurality of additional threads extending warpwise between said first-named core thread and said another core thread and interlaced with said weft thread and said limbs.

3. A slide fastener stringer comprising:

(a) a woven stringer tape including a plurality of warp threads and a weft thread interlaced in double picks with said warp threads, said weft thread having a plurality of loops disposed along a longitudinal edge of said stringer tape and each extending from adjacent two of said double picks;

(b) a core thread extending warpwise through said loops in engagement therewith;

(c) a filamentary coupling element having a plurality of turns spaced longitudinally of the tape, each of said turns including a pair of spaced limbs between which said core thread extends, and a coupling head disposed between said limbs, said element further having a plurality of connecting portions each extending between adjacent two of said limbs which are located on one side of said core thread, each of said double picks underlying one of said connecting portions and blending into adjacent two of said loops; and (d) another thread extending warpwise and fastened between the double picks and such limbs of said turns which overlie said core thread.

4. A slide fastener stringer according to claim 3, said weft thread extending over said last-named limbs adjacent to said coupling heads.

* * * * *